US011192215B2

(12) United States Patent
Guzman et al.

(10) Patent No.: US 11,192,215 B2
(45) Date of Patent: Dec. 7, 2021

(54) POLISHING PAD WITH PAD WEAR INDICATOR

(71) Applicant: Rohm and Haas Electronic Materials CMP Holdings, Inc., Newark, DE (US)

(72) Inventors: Mauricio E. Guzman, Bear, DE (US); Matthew R. Gadinski, Newark, DE (US); Nestor A. Vasquez, Middletown, DE (US); Guanhua Hou, Mullica Hill, NJ (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 627 days.

(21) Appl. No.: 16/185,643

(22) Filed: Nov. 9, 2018

(65) Prior Publication Data

US 2019/0224811 A1 Jul. 25, 2019

Related U.S. Application Data

(63) Continuation-in-part of application No. 15/815,121, filed on Nov. 16, 2017, now Pat. No. 10,465,097.

(51) Int. Cl.

| | |
|---|---|
| ***B24D 18/00*** | (2006.01) |
| ***B24B 37/24*** | (2012.01) |
| ***B24B 37/22*** | (2012.01) |
| ***B24B 37/16*** | (2012.01) |
| ***B24B 37/26*** | (2012.01) |
| *B24D 3/00* | (2006.01) |
| *B24D 11/00* | (2006.01) |
| *C09K 3/14* | (2006.01) |

(52) U.S. Cl.

CPC ..... *B24B 37/24* (2013.01); *B24B 37/16* (2013.01); *B24B 37/22* (2013.01); *B24B 37/26* (2013.01)

(58) Field of Classification Search

USPC ..... 51/293, 298, 299

See application file for complete search history.

(56) References Cited

U.S. PATENT DOCUMENTS

| | | | | |
|---|---|---|---|---|
| 5,913,713 | A | 6/1999 | Cheek et al. | |
| 6,040,244 | A | 3/2000 | Arai et al. | |
| 6,090,475 | A | 7/2000 | Robinson et al. | |
| 6,106,661 | A * | 8/2000 | Raeder | B24B 37/26 156/345.12 |
| 9,017,140 | B2 * | 4/2015 | Allison | B24B 37/205 451/6 |
| 9,138,860 | B2 | 9/2015 | Dhandapani et al. | |
| 2013/0237136 | A1 * | 9/2013 | Newell | B24D 11/001 451/527 |

(Continued)

OTHER PUBLICATIONS

Copending U.S. Appl. No. 16/185,725.

*Primary Examiner* — James E McDonough
(74) *Attorney, Agent, or Firm* — Blake T. Biederman

(57) ABSTRACT

The invention provides a polishing pad suitable for polishing integrated circuit wafers. A polyurethane polishing layer has a top surface and at least one groove in the polyurethane polishing layer. At least one copolymer wear detector located within the polyurethane polishing layer detects wear of the polishing layer adjacent the at least one groove. The at least one wear detector includes two regions, a first region being a fluorescent acrylate/urethane copolymer linked with a UV curable linking group and a second non-fluorescent region, The wear detector allows detecting wear of the polishing layer.

9 Claims, 9 Drawing Sheets

(56) References Cited

U.S. PATENT DOCUMENTS

2015/0140691 A1* 5/2015 Liu ..... B24B 37/044
438/8
2017/0157733 A1 6/2017 Shi

* cited by examiner

Prior Art

POLISHING PAD WITH PAD WEAR INDICATOR

This application is a continuation-in-part of U.S. Ser. No. 15/815,121, filed Nov. 16, 2017, now pending.

BACKGROUND

Chemical Mechanical Planarization (CMP) is a variation of a polishing process that is widely used to flatten, or planarize, the layers of construction of an integrated circuit in order to precisely build multilayer three dimensional circuitry. The layer to be polished is typically a thin film (less than 10,000 Angstroms) that has been deposited on an underlying substrate. The objectives of CMP are to remove excess material on the wafer surface to produce an extremely flat layer of a uniform thickness, said uniformity extending across the entire wafer area. Control of removal rate and the uniformity of removal are of paramount importance.

CMP utilizes a liquid, often called slurry, which contains nano-sized particles. This is fed onto the surface of a rotating multilayer polymer sheet, or pad, which is mounted on a rotating platen. Wafers are mounted into a separate fixture, or carrier, which has a separate means of rotation, and pressed against the surface of the pad under a controlled load. This leads to a high rate of relative motion between the wafer and the polishing pad. Slurry particles trapped at the pad/wafer junction abrade the wafer surface, leading to removal. In order to control rate, prevent hydroplaning, and to efficiently convey slurry under the wafer, various types of texture are incorporated into the upper surface of the polishing pad. Fine scale texture is produced by abrading the pad with an array of fine diamonds. This is done to control and increase removal rate, and is commonly referred to as conditioning. Larger scale grooves of various patterns and dimensions (e.g., XY, circular, radial) are also incorporated for hydrodynamic and slurry transport regulation.

The lifetime of a polishing pad is determined by its ability to maintain a constant level of performance set by the device manufacturer. The most common factors limiting pad lifetime are drift in removal rate, and permanent changes in the uniformity of removal across the wafer area. Pad wear is a major root cause of both issues. Diamond conditioning, used to correct rate drift, causes wear on the upper pad surface, with a continuous reduction in thickness. As this proceeds, the groove depth continuously decreases. Eventually, the groove cannot maintain the needed hydrodynamic state and the end of pad life is reached. In practice, estimation of pad life is difficult. Mechanical measurement of groove depth requires stopping the polishing machine, which reduces throughput and utilization. The most common techniques used to measure pad wear and changes in groove depth are non-contact surface measurements. Examples of these types of approaches are found in U.S. Pat. No. 6,040,244 (ultrasonic interferometry), and U.S. Pat. No. 9,138,860 (laser or eddy current displacement sensors). While such techniques can measure changes in pad thickness and shape over its entire surface to determine the pad wear rate, commercial systems are very expensive and cannot readily be retrofitted into older polishing machines.

Accordingly, various means of providing pad wear indicators that are built into the pad itself have been developed, which can be used on any polishing machine.

U.S. Pat. No. 5,913,713 disclosed a method for providing a pad wear indicator by producing a series of grooves or cavities in the back side of the upper pad layer. These could be filled with an opaque or high contrast material. As the pad wears, these buried grooves become visible, allowing the operator to call the end of pad life based on the degree of contrast. By using a series of cavities with varying heights, pad wear could be estimated by recording the time to reach each layer. This technique is labor intensive and relatively subjective.

U.S. Pat. No. 6,090,475 disclosed an alternative means of providing a colorimetric pad wear indicator. Colored dyes were applied to the bottom surface of the upper pad layer during manufacturing, which diffused to a predetermined partial depth into the pad. Conditioning wear exposed the dye, giving an indication that pad wear had proceeded to a degree requiring pad replacement. This method is extremely difficult to control, and, furthermore, does not provide a means of measuring the pad wear rate prior to the end of life.

U.S. Pat. No. 6,106,661 disclosed methods for producing a pad wear indicator on the upper pad layer. A series of recesses of varying depths and locations across the pad surface was produced either on the front surface or back surface of the top pad layer and optionally filled with a material of contrasting color. Pad wear by the conditioning process exposed the buried indicator manifested by the appearance of a differently colored spot. Also disclosed was the employment of an unfilled recessed feature or trench on the top surface of the upper pad layer, which would disappear once the pad was worn down to the depth of the recess. In the patent, there was no mention of the incorporation of grooves for hydrodynamic and conveyance control, nor were grooves shown in any of the figures, either for prior art or for invention examples. The wear data were directed toward measuring the overall thinning of the upper pad layer for control of compliance. It did disclose that the technique could provide overall pad wear rates in the same manner as U.S. Pat. No. 5,913,713.

More recently, US Patent Pub. No. 2017/0157733 disclosed yet another pad wear monitoring technique. A plurality of marker patterns are stacked in locations on the pad that consist of arrays of different patterns varying in design at intervals from the top surface of the upper pad layer to the bottom. As the pad wears, different markers are exposed. This can be combined with a machine vision system to provide status on the progression of wear in the pad.

All of the pad-based approaches cited above have significant deficiencies that have prevented their widespread use. These are as follows: (1) significant added cost to the polishing pad manufacturing process by their inclusion; (2) interpretation of results is mostly subjective; (3) the approaches are physically intrusive and have the potential to alter the polishing characteristics of the pad; (4) there is no easy means for a user to determine in advance of the exposure of a marker when the pad is approaching a critical wear depth without the addition of multiple markers or expensive additional metrology on the polishing tool; and (5) none of these approaches disclose the ability to tailor the conditioning wear of the indicator material to that of the top layer of the polishing pad.

From the above discussion it is clear that an efficacious pad wear indicator could be developed that could provide continuous wear data without added metrology, it would be a significant improvement in the state of the art.

STATEMENT OF INVENTION

An embodiment of the invention includes a polishing pad suitable for polishing integrated circuit wafers comprising: a polyurethane polishing layer that contacts an article to be polished, the polyurethane polishing layer having a top surface; at least one groove in the polyurethane polishing layer, the at least one groove extending downward from the top surface of said polyurethane polishing layer, the at least one groove having a depth, at least one copolymer wear detector located within the polyurethane polishing layer for detecting wear of the polishing layer adjacent the at least one groove, the at least one wear detector having a wear rate similar to the wear rate of the polyurethane polishing layer during diamond conditioning and the at least one wear detector including two regions, a first region being a fluorescent acrylate/urethane copolymer linked with a UV curable linking group, wherein the at least one wear detector allows detecting wear of the polishing layer adjacent the at least one groove by activating a fluorescent group within the fluorescent acrylate/urethane copolymer with an activation source at a wavelength sufficient to excite the fluorescent transparent polymer.

DETAILED DESCRIPTION OF THE INVENTION

The essential features of the present invention are the use of a copolymer wear indicator in a polishing pad to provide fluorescent functionality in a pad wear indicator. This is effected by incorporating fluorescent acrylate into a urethane polymer to form a fluorescent urethane acrylate copolymer. For purposes of this specification, urethane polymers include urethanes, ureas and blends of urethanes and ureas. One region is a non-fluorescent material such as a porous or a non-porous polyurethane or a non-porous urethane-acrylate copolymer. A second region contains a fluorescent moiety that is part of the polymer structure itself. By adjusting the relative thicknesses of the two layers so that the boundary interface is referenced to the desired final depth of grooves in the pad, the wearing away of the upper layer during pad use can be employed as a groove wear indicator.

Figure 1:
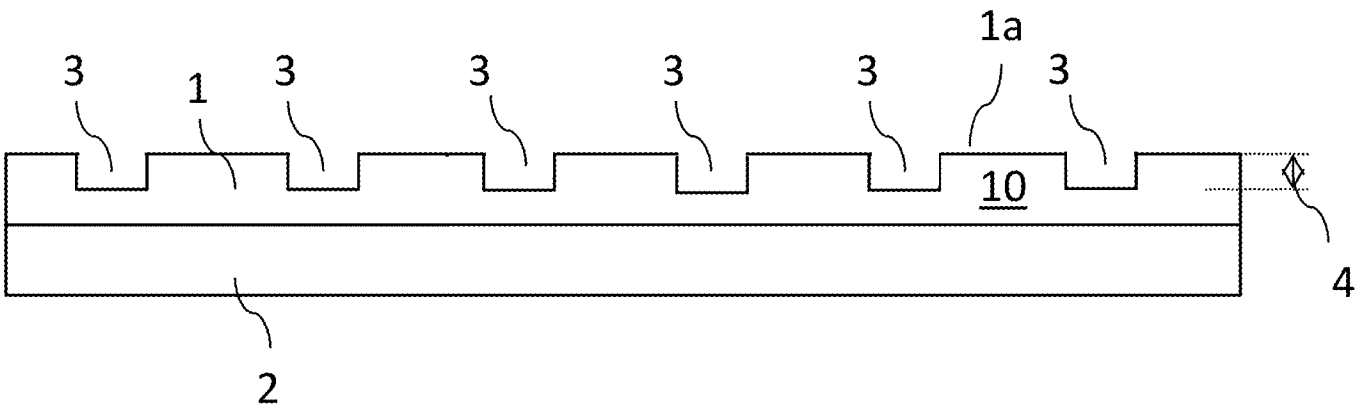
FIG. 1 is a schematic drawing of a conventional grooved CMP polishing pad for use in polishing semiconductor wafers.

FIG. 1 is a schematic diagram of a conventional prior art polishing pad (10). This prior art CMP polishing pad (10) consists of a multi-level composite comprising an upper pad layer (1) and, optionally, a lower pad layer or subpad (2). The upper pad layer (1), which includes the polishing surface (1*a*) that contacts the substrate to be polished. The polishing layer includes a series of grooves (3) that have a depth (4). This groove depth (4) is less than the total thickness of the upper pad layer (1). FIGS. 1 to 4 include the same component identifications.

Figure 2:
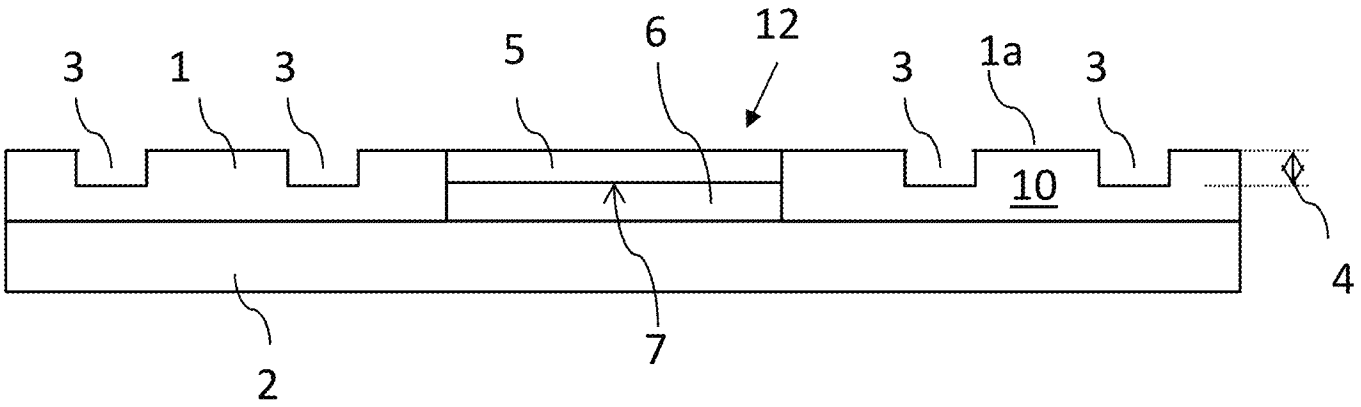
FIG. 2 is a schematic drawing of a copolymer wear detector in a CMP polishing pad for use in polishing pad wear detection.

Referring to FIG. 2, polishing pad (10) includes a pad wear indicator (12) formed from two regions (5) and (6). The top indicator region (5) has fluorescent properties, i.e., it emits light when illuminated with radiation whose wavelength corresponds to the excitation wavelength of the fluorescent species. The total thickness of the copolymer wear indicator (12) is equivalent to the upper pad layer thickness. The upper region (5) has a thickness equivalent to or less than the upper pad layer groove depth (4). The lower region (6) is a non-fluorescent polymer of composition identical to the fluorescent layer (5) except that the fluorescent polymer is absent. Optionally, the lower region (6) may be the same material as the upper pad layer (1). The boundary interface (7) between the two copolymer wear indicator layers is situated on a plane that is slightly higher than the original groove depth (4).

The wear indicator (12) includes two regions (5) and (6) that are placed in the same plane as the upper pad layer (1). Optionally, region (5) may have a height just below the surface of the polishing surface (1*a*). This imparts a lag in the wear of region (5) until the polishing surface (1*a*) is coplanar with region (5). The boundary interface (7) between the upper indicator region (5) and the lower indicator region (6) is situated on a plane parallel to the polishing surface (1*a*) of the top pad layer (1), whose distance from the upper surface of the upper pad region (5) is slightly less than the recess depth (4) of the pad grooves (3). In the Figure, the top indicator region (5) has fluorescent properties, i.e., it emits light when illuminated with ultraviolet radiation. The lower region (6) is a non-fluorescent polymer of composition identical to the fluorescent region (5) except that the fluorescent polymer is absent. When the pad is mounted into the polishing machine, illumination of the upper surface of the pad will produce a fluorescent light emission arising from the area of the indicator. As the pad is used to polish integrated circuit wafers and conditioned, pad wear occurs over all of the upper features, including the upper indicator region (5). Over time, there is a continuous reduction in the upper pad region (1) as well as the upper indicator region (5). Eventually the depth of wear is sufficient to completely remove the upper indicator region (5). At this point, exposure of the pad (10) to ultraviolet radiation produces no fluorescence. This loss of fluorescent response signals that the pad has reached the end of its useful life and should be replaced. It is appreciated that the copolymer wear polymer indicator boundary interface (7) can be adjusted relative to any depth of wear desired. Advantageously, the boundary interface has an end location of less than or equivalent to the depth of the at least one groove. For example, if a user wishes to call end of pad life at 80% removal of the groove depth (4), the boundary interface (7) of the copolymer wear indicator can be set accordingly. Advantageously, the upper layer (1) and the upper indicator region (5) wear at the same rate during diamond conditioning. This embodiment of the invention does not provide an accurate means of indicating the progression of pad wear. As the upper indicator region (5) becomes thinner, the total fluorescence is not expected to diminish in a proportional manner, especially if the UV illumination wavelength is below the minimum transparency wavelength of the layer.

Optionally, it is possible to reverse the fluorescent regions (5) with the non-fluorescent region (6). In this embodiment, the arrival of fluorescent light signals the end of the useful groove depth and polishing pad life.

Figure 3:
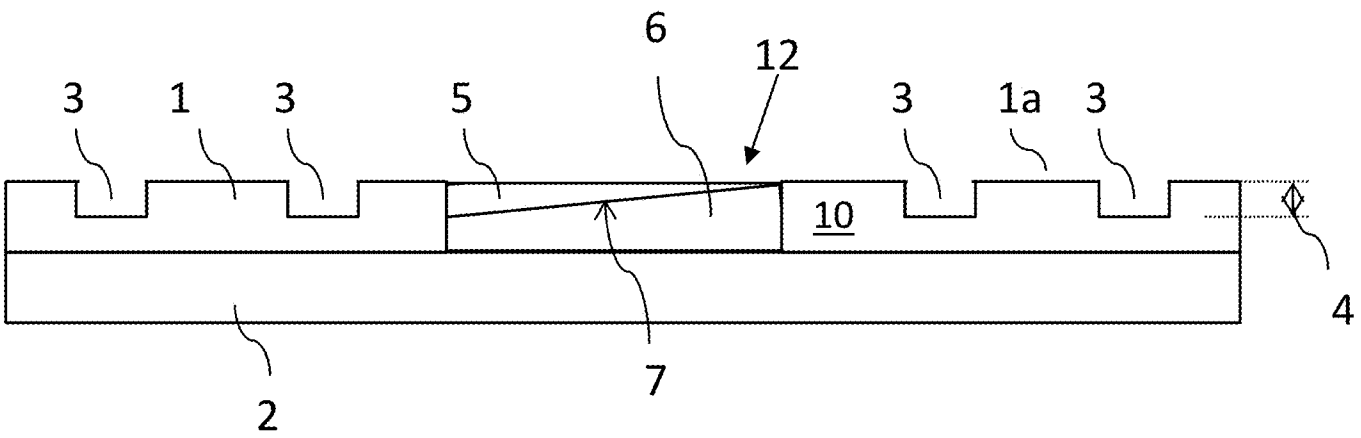
FIG. 3 is a schematic drawing of a copolymer wear detector in a CMP polishing pad for use in polishing pad wear detection having an angled boundary interface.

FIG. 3 is to an embodiment for continuously determining wear of the upper layer (1). This copolymer wear indicator (12) employs a sloped boundary interface (7) below the upper and lower indicator regions. The slope is at an angle to the top plane of the upper pad layer (1) and polishing surface (1*a*). In this embodiment, the angle of the boundary interface is adjusted such that the thickest part of the upper indicator region (5) is at a depth below the upper pad region (1) surface that is equivalent to the groove depth (4). At the opposite side of the copolymer wear indicator (12), the boundary interface (7) is at the upper surface of the pad (10). When viewed from above under ultraviolet illumination, the entire area of the copolymer wear indicator fluoresces, as shown in FIG. 4*a*. Advantageously, the upper layer (1) and the upper indicator region (5) wear at the same rate.

Figure 3A:
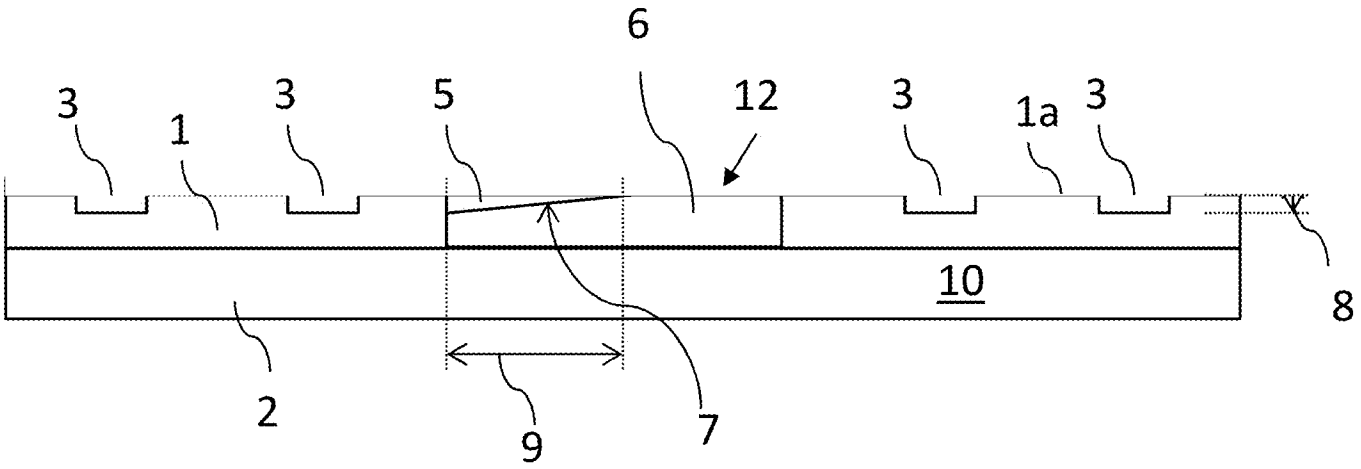
FIG. 3*a* is the schematic drawing of FIG. 3 with half of the groove depth remaining.
Figure 3B:
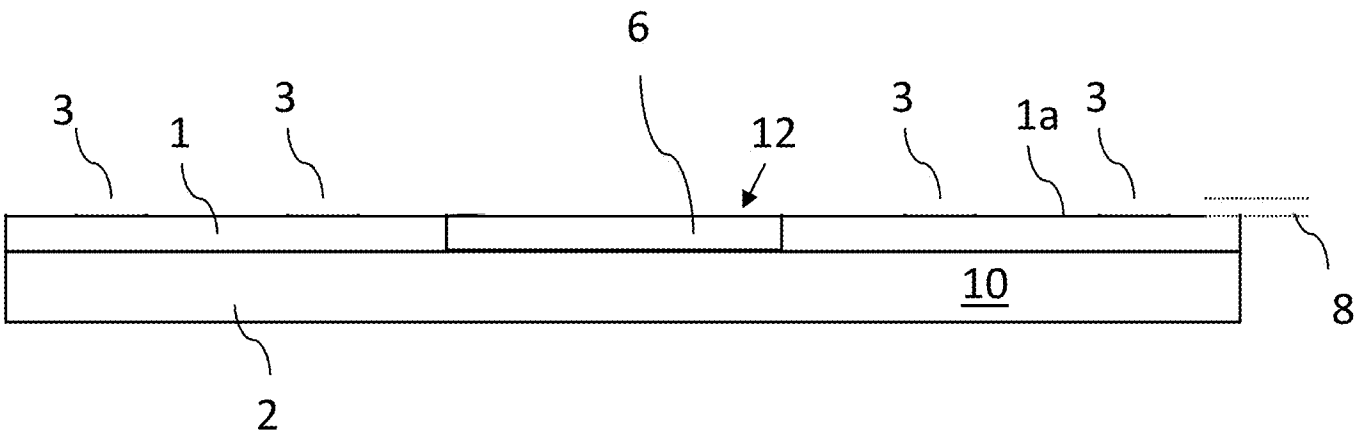
FIG. 3*b* is the schematic drawing of FIG. 3 with none of the groove depth remaining.
Figure 4:
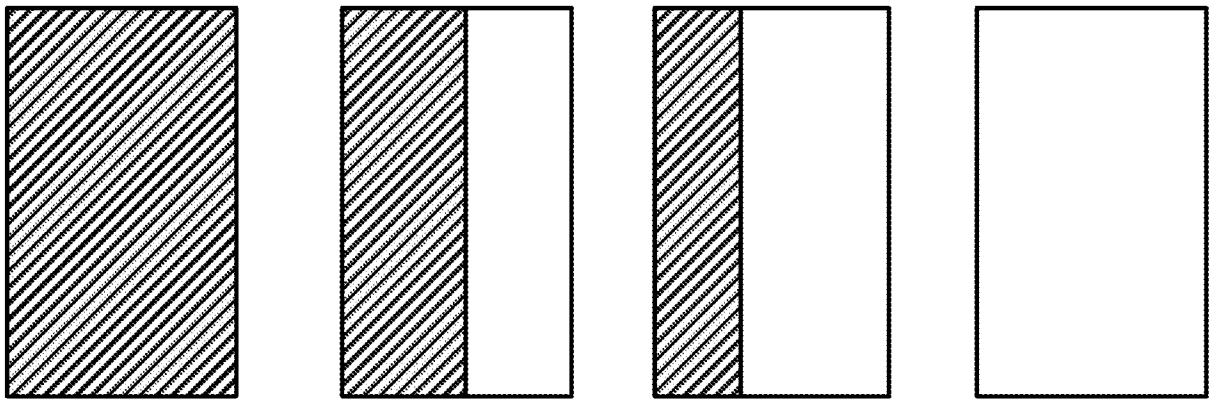
FIG. 4, schematic views a to d illustrate the change in fluorescent image seen from above the pad of FIG. 3 when it is illuminated with ultraviolet radiation with the cross hatching indicating the presence of fluorescence.

As the pad is used, and wear begins (see FIG. 3*a*), the location of the copolymer boundary interface (7) at the upper surface shifts away from the edge of the copolymer indicator as a portion of the lower indicator region (6) is exposed. At this point, the grooves (3) have worn down 50% to depth (8). Similarly, the width of upper indicator region (6) reduces 50% to width (9). Since less area of the upper wear indicator region (5) exists, the amount of fluorescence observed under ultraviolet illumination is reduced accordingly. As wear continues (see FIG. 3*b*), the percentage of the lower wear indicator region (6) that is exposed increases directly with the amount of wear, and the fluorescent area of the indicator decreases directly until the depth of pad wear is equivalent to the groove depth (8). At this point, the grooves (3) have worn the remaining depth (8) and the upper wear indicator region (5) no longer exists. Thus, there is no fluorescence produced when the pad is illuminated with ultraviolet radiation. Since the width of the fluorescing portion of the indicator is correlated to the amount of pad wear relative to the groove depth, the user of such a pad can immediately and quantitatively determine the extent of groove wear simply by observing the pad under ultraviolet illumination, as shown graphically by FIGS. 4*a* to *d*. Moreover, the change in the width of the fluorescent image over time can be used to precisely calculate the wear rate of the pad.

Most advantageously, the upper layer (1) and the upper wear indicator region (5) wear at the same rate; and the upper wear indicator region (5) and lower indicator region (6) also wear at the same rate. The boundary interface (7) most advantageously has a thickness of greater than or equivalent to the depth of the at least one groove. Optionally, the two wear regions (5) and (6) may have a height just below the surface of the polishing surface (1*a*). When the height is less than that of the pad top layer surface (1*a*), there is a polishing lag time before the fluorescent signal begins to change with pad wear.

FIGS. 4*a* to 4*d* illustrate the change in fluorescent with wear of the polishing pad (10) of FIG. 3. FIG. 4*a* represents the fluorescent image of the pad as produced. The entire area of the composite window fluoresces. FIG. 4*b* represents the fluorescent image of the composite window at the point when 50% of the groove depth has been removed by wear. Only 50% of the area of the composite window is fluorescent. FIG. 4*c* represents the fluorescent image of the composite window when 75% of the groove depth has been removed. Only 25% of the area of the composite window is fluorescent. FIG. 4*d* represents the fluorescent image of the composite window when the wear depth is equivalent or greater than the desired groove finishing depth. No fluorescence is observed. Advantageously, the boundary interface has an end location of less than or equivalent to the depth of the at least one groove. The end location can be at any location along the path from 4*a* to 4*d*. Most advantageously, the end location is at location 4*d* where no fluorescent light signal exists.

Optionally, it is possible to reverse the fluorescent regions (5) with the non-fluorescent region (6). In this embodiment, the increasing fluorescent light signals wear and ultimately, the end of the groove life. The wear indicator geometry can be easily modified to fit any desired groove depth, or desired pad wear depth at which to call end of life for the pad. Moreover, it can be employed in any variation in cross sectional area, as viewed from above as desired. It is also appreciated that methods other than visual observation can be employed to detect and quantify the fluorescent response. These include machine vision systems, spectrophotometric detection and analysis systems, and modification of existing optical endpointing systems.

The other critical feature of all embodiments of the invention is that the copolymer wear indicator has mechanical properties and conditioning wear rates that are matched to the upper pad layer (1) that the copolymer wear indicator is being used with. As will be appreciated by those skilled in the art, a wide variety of polymers may be used for construction of copolymer wear indicators of the invention, and specific illustrative examples shown here are not meant to be limiting in any way, as long as the final material properties meet requirements.

Figure 5:
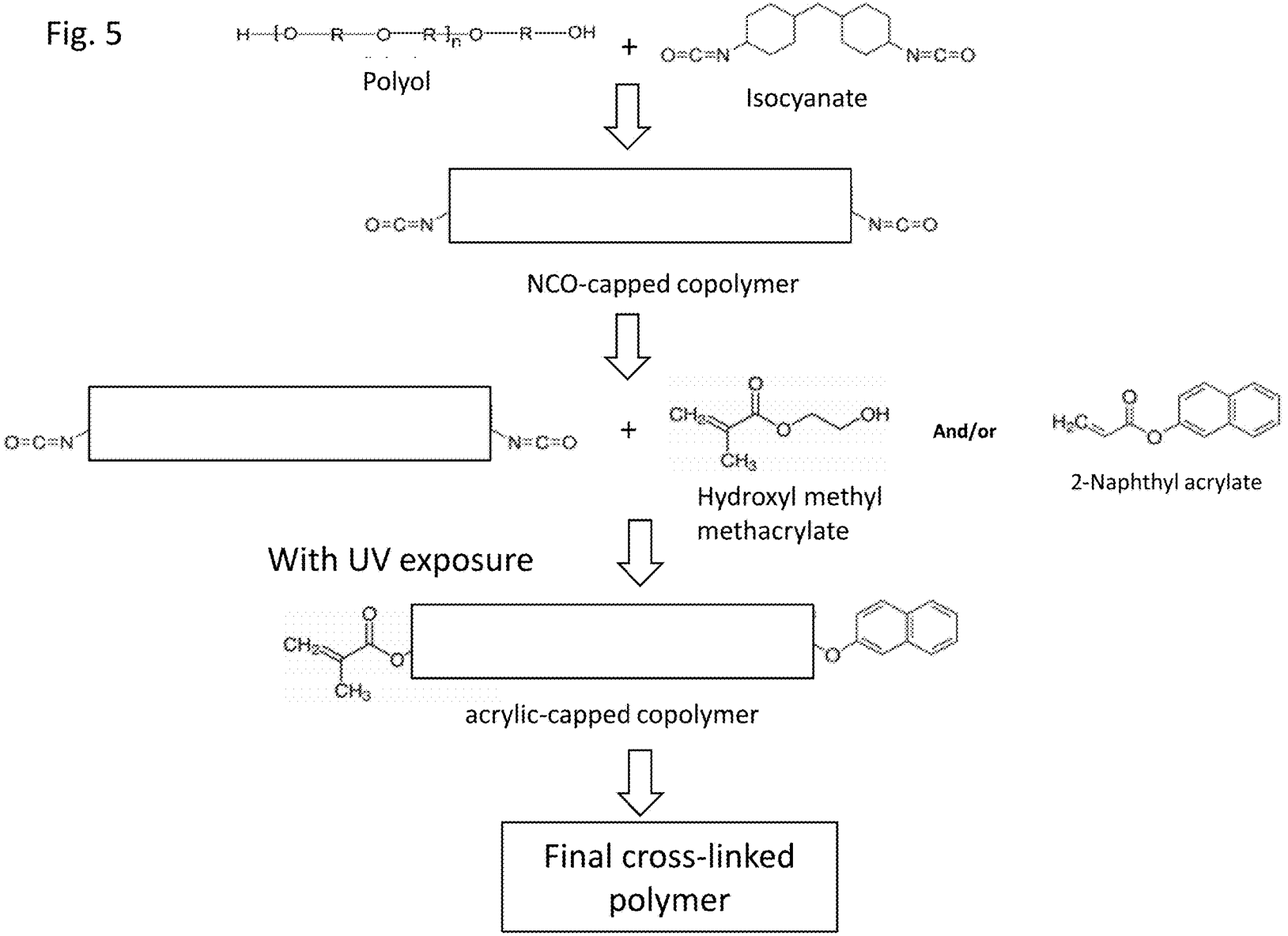
FIG. 5 is a schematic diagram of the sensor material synthesis process.

An additional consideration in the use of fluorescent species in the articles of the current invention is that they should not leach out of the indicator during use, or be reactive to slurry components. Accordingly, the ideal approach is to incorporate the fluorescent species into the polymer structure. The most suitable means of effecting this is to utilize a urethane/acrylate copolymer containing a UV curable linking group as the base indicator composition. Advantageous examples of UV curable linking group moieties include acrylate, methacrylate and acrylamide linking groups. Advantageously, the fluorescent moiety is chemically linked to the UV curable polymer. By addition of fluorescent acrylate monomers into the polymerization process, one can produce structurally bound polymers containing the desired fluorescent species in a wide range of concentrations. More importantly, addition of the fluorescent monomer can be made as a partial substitution for other acrylate monomers used in the synthesis. This allows production of the fluorescent polymer with the same physical and mechanical properties as the un-doped parent, which is preferred for producing a copolymer wear indicator that wears in a manner similar to the polishing pad. A flow chart of this synthesis process, corresponding to that used for the Example, is shown in FIG. 5. In the synthesis process, the 2-napthyl acrylate requires UV exposure to form the acrylic-capped copolymer, but the hydroxyl methyl methacrylate does not.

Fluorescent monomers are commercially available with a wide variety of fluorophores. Fluorescent monomers of particular use include the following: 9-anthracenyl methyl methacrylate (excitation wavelength 362 nm, emission wavelength 407 nm), 1-pyrenyl methyl methacrylate (excitation wavelength 339 nm, emission wavelength 394 nm), 2-naphthyl acrylate (excitation wavelength 285 nm, emission wavelength 345 nm), 2-naphthyl methacrylate (excitation wavelength 285 nm, emission wavelength 345 nm), fluorescein dimethacrylate (excitation wavelength 470 nm, emission wavelength 511 nm), propargyl acrylate (excitation wavelength 281 nm, emission wavelength 425 nm), and dansyl acrylate (excitation wavelength 365 nm, emission wavelength 550 nm). It is recognized that any fluorescing moiety that can be produced as an acrylate, or methacrylate could be used to produce articles of the present invention. Most advantageously, the fluorescent acrylate/urethane copolymer includes at least one fluorescent moiety selected from 2-naphthyl acrylate; 9-anthracenyl methyl methacrylate; and 1-pyrenyl methyl methacrylate.

Production of the copolymer wear indicators of the present invention can be prepared via a number of techniques including, but not limited to, casting, preparation, and bonding of two separate layers, and, preferably, casting a layer of the uncured fluorescent polymer on top of a cured sheet of the cured non-fluorescent polymer, and curing the cast composite to produce a two layer body. This produces a copolymer sheet with very high interfacial strength that is free from defects. A simple and cost-effective means of preparing the final copolymer wear indicators having variable angular differences between the interface plane and the physical plane of the entire copolymer wear indicator is to first produce a planar copolymer sheet, cutting the sheet into blanks, and machining the top and bottom surfaces to achieve the desired interface angle and final indicator dimensions, such as shown in FIG. 3.

Following production of the finished copolymer wear indicator, it may be incorporated into the final polishing pad. Final assembly can be effected by numerous means, including, but not limited to, inserting a indicator into an aperture in the top pad layer and cementing it in place, ultrasonic welding, or casting the top pad layer around the indicator via techniques such as injection molding or compression molding to produce a single net shaped top pad layer, with the copolymer wear indicator cast in place.

EXAMPLE

Three samples were made to assess the effects of base polymer and effect of the fluorescent species concentration on properties and performance. For Samples 1a and 1b, 55.8 g of Voranol™ 220-110 multi-functional polyol was mixed with 4,4'-Methylene dicyclohexyl diisocyanate ($H_{12}$MDI), heated to 80° C. and held for 4 hours to make the base prepolymer. For Sample 2, Adiprene™ L325 polyurethane prepolymer was used as received. To the above synthesized and commercial prepolymers 37 g of hydroxyethyl methacrylate was added, mixed, and held at 80° C. for 12 hours. This produced the acrylate end-capped polyurethane samples. To make these fluorescent 0.0137 g (100 ppm) of 2-napthyl acrylate monomer was added to 1a and 2, and 0.137 g (1000 ppm) was added to MTL5UV-F2. To each of these formulation 0.1 wt % of camphorquinone UV initiator and 0.2 wt % N-methyldiethanolamine as co-initiator was added and dissolved. These mixtures were then individually poured and sandwiched between two glass plates and exposed to UV light via halogen bulb for 5 minutes.

Mechanical properties of the samples in comparison to the pad in which the indicator will be used (VP5000) are shown in Table 1. The properties Sample 1 was found to match that of a filled hard pad closely, except for elongation. With these properties the wear rates should remain comparable.

TABLE 1

Mechanical properties of UV curable formulations and comparison materials.

| Pad Sample | Hardness (Shore D) | G' 30° C. (MPa) | G' 40° C. (MPa) | Tensile Strength, (MPa) | Elongation (%) | Tensile Modulus (MPa) |
|---|---|---|---|---|---|---|
| Sample 1 | 58.9 | 104 | 75 | 13.1 | 6 | 290 |
| Sample 2 | 64.9 | 129 | 79 | 26.5 | 33 | 383 |
| Filled VP5000 | 61.8 | 157 | 125 | 29.3 | 229 | 269 |

Figure 6:
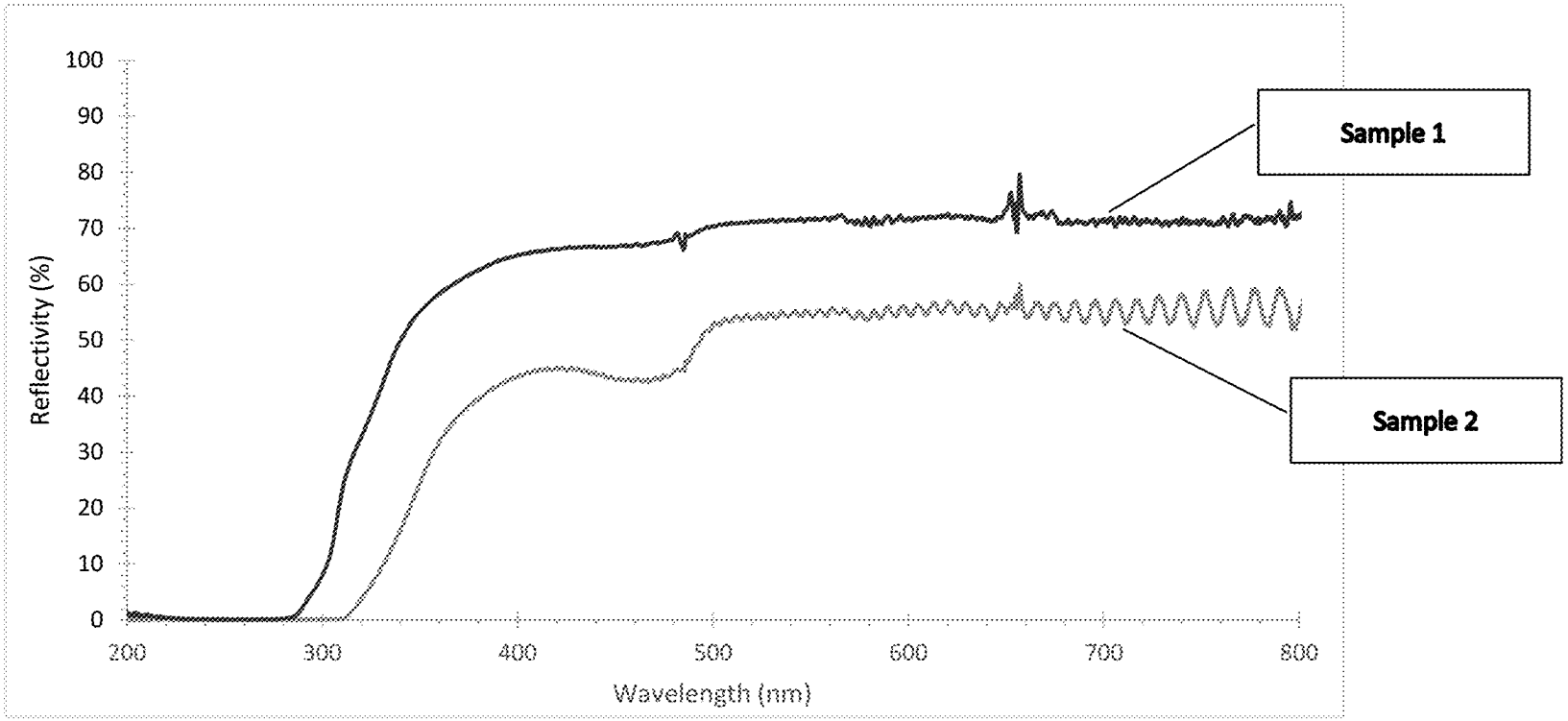
FIG. 6 plots the transmission spectrum of the fluorescent copolymers described in Example 1.

The transmission spectrum of the undoped parent polymer is shown in FIG. 6. Sample 1 (without fluorescent monomer) demonstrates high transmission down to 300 nm. Sample 2 does not and should show limited fluorescence when incorporated into that formulation, which makes its use in the present invention undesirable.

Figure 7:
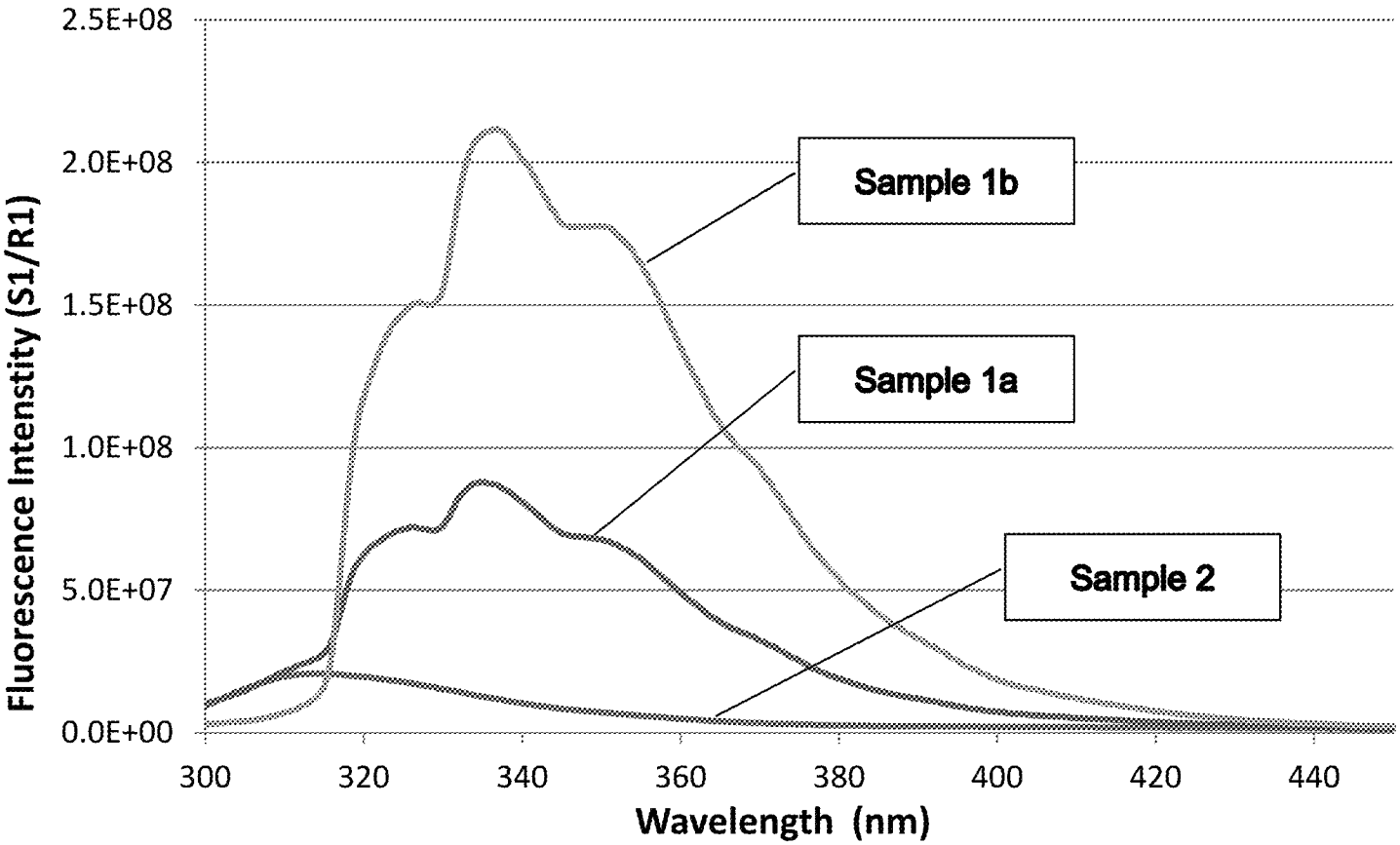
FIG. 7 plots the fluorescence spectra of fluorescent copolymers described in Example 1.

The fluorescence spectrum of the doped polymer is shown in FIG. 7. As expected Sample 1a exhibits limited fluorescence, as the UV light cannot transmit through the material and cannot excite the 2-naphthyl acrylate linked into the polymer structure. Sample 1a with the same level of 2-naphthyl acrylate doping shows a significant peak at 345 nm that is the reported emission wavelength of 2-naphthyl acrylate. Sample 1b with an order of magnitude increase in fluorescent monomer content shows that fluorescence can be increased by increasing fluorescent monomer doping. It should be noted that while the primary fluorescence intensity is below the limit of human vision (380 nm), the broad emission spectrum allows human observation of the fluorescence as a violet color.

In summary, the invention provides a combination of polishing pad wear and life without the need to retrofit tools with expensive hardware solutions. In addition, the use of an angled boundary interface can function analogous to a gas gauge to monitor polishing pad wear rate and groove life.

We claim:

1. A polishing pad suitable for polishing integrated circuit wafers comprising:

a polyurethane polishing layer that contacts an article to be polished, the polyurethane polishing layer having a polishing surface;

at least one groove in the polyurethane polishing layer, the at least one groove extending downward from the polishing surface of said polyurethane polishing layer, the at least one groove having a depth, at least one copolymer wear detector located within the polyurethane polishing layer for detecting wear of the polishing layer adjacent the at least one groove, the at least one wear detector having a wear rate similar to the wear rate of the polyurethane polishing layer during diamond conditioning and the at least one wear detector including two regions, a first region being a fluorescent acrylate/urethane copolymer linked with a UV curable linking group and a second non-fluorescent region, wherein the at least one wear detector allows detecting wear of the polishing layer adjacent the at least one groove by activating a fluorescent group within the fluorescent acrylate/urethane copolymer with an activation source at a wavelength sufficient to excite the fluorescent transparent polymer.

2. The polishing pad of claim 1 wherein a boundary interface separates the non-fluorescent transparent polymer from the fluorescent transparent polymer.

3. The polishing pad of claim 2 wherein the boundary interface is parallel to the polishing surface of the polishing pad.

4. The polishing pad of claim 2 wherein the boundary interface is at an angle to the polishing surface of the polishing pad for continuous determination of pad wear.

5. The polishing pad of claim 2 wherein the boundary interface has an end location of less than or equivalent to the depth of the at least one groove.

6. The polishing pad of claim 1 wherein the fluorescent acrylate/urethane copolymer contains an acrylate linking group.

7. The polishing pad of claim 1 wherein the fluorescent acrylate/urethane copolymer contains a methacrylate linking group.

8. The polishing pad of claim 1 wherein the fluorescent acrylate/urethane copolymer contains an acrylamide linking group.

9. The polishing pad of claim 1 wherein the fluorescent acrylate/urethane copolymer wears at a similar rate to the non-fluorescent transparent polymer and the fluorescent acrylate/urethane copolymer includes at least one fluorescent moiety selected from 2-naphthyl acrylate; 9-anthracenyl methyl methacrylate; and 1-pyrenyl methyl methacrylate.

* * * * *